United States Patent [19]

Black et al.

[11] 4,051,777

[45] * Oct. 4, 1977

[54] STENCILLING APPARATUS WITH FLOW THROUGH PRINT AND FLOW ACTION

[75] Inventors: James A. Black, Kent City; Harry Russell Farwell, Cedar Springs; Frank L. Porth, Morley, all of Mich.

[73] Assignee: James A. Black, Kent City, Mich.

[ * ] Notice: The portion of the term of this patent subsequent to Apr. 10, 1993, has been disclaimed.

[21] Appl. No.: 688,610

[22] Filed: May 21, 1976

Related U.S. Application Data

[63] Continuation-in-part of Ser. No. 518,768, Oct. 29, 1974, Pat. No. 3,973,491.

[51] Int. Cl.[2] ..... B41F 15/42

[52] U.S. Cl. ..... 101/123; 101/124

[58] Field of Search ..... 101/123, 124, 119, 120, 101/115; 118/213, 406

[56] References Cited

U.S. PATENT DOCUMENTS

| | | | |
|---|---|---|---|
| 3,252,411 | 5/1966 | Black | 101/124 |
| 3,973,491 | 8/1976 | Porth et al. | 101/124 |

*Primary Examiner*—Edgar S. Burr
*Assistant Examiner*—R. E. Suter
*Attorney, Agent, or Firm*—Price, Heneveld, Huizenga & Cooper

[57] ABSTRACT

Stencilling apparatus having a print and flow action relative to a combination squeegee and flow coater assembly, wherein excess stencilling fluid ahead of the squeegee can flow through the assembly, by flow over the squeegee into a control reservoir behind the squeegee and ahead of the trailing flow coater, and a controlled layer of the fluid flows from the reservoir beneath the lower edge of the flow coater onto the underlying stencil screen.

2 Claims, 7 Drawing Figures

STENCILLING APPARATUS WITH FLOW THROUGH PRINT AND FLOW ACTION

RELATED APPLICATION

This is a continuation-in-part of copending application Ser. No. 518,768, filed Oct. 29, 1974, and entitled FLOOD COATER AND SQUEEGEE, now U.S. Pat. No. 3,973,491.

BACKGROUND OF THE INVENTION

This invention relates to stencilling apparatus, and more particularly to screen stencilling, usually for printing, employing a direct, regulated flow through action from ahead of the squeegee to behind the flow coater, by passage over the squeegee into a control reservoir between the squeegee and the flow coater, and from the reservoir onto the stencil screen.

Screen stencilling is widely used for selectively depositing coating materials such as inks, adhesives, and other functional and/or decorative deposits through a screen stencil onto stock such as paper, polymers, cloth, wood, laminates, and the like for making posters, decalcomania coatings, graphic designs, and the like. A typical apparatus for screen stencilling is set forth in U.S. Pat. No. 2,606,492. Usually, the process involves the spreading of a layer of the fluid on a fine mesh screen, followed by forcing a portion of the fluid layer through the pattern areas of the screen with a squeegee, onto the stock. The excess ink is forced to one end of the screen by this squeegee. The excess ink is subsequently spread back onto the screen by a flow coater for the next stencilling stroke. A common tendency of the stencilling fluid is to thicken or even dry because of solvent or carrier liquid evaporation while the excess stencilling fluid is repeatedly wiped off the stencil screen ahead of the squeegee and spread again onto the stencil screen on the return stroke.

SUMMARY OF THE INVENTION

An object of this invention is to provide novel flow through stencilling apparatus wherein the stencilling fluid is constantly maintained in a controlled amount on the stencil screen both ahead of and behind the squeegee-flow coater assembly. The stencil screen is not exposed to the air to allow fluid clinging to the screen strands to dry and partially or totally plug screen openings. Rather, the screen is kept constantly covered. This also keeps the screen openings filled with fluid rather than allowing air entry therein, thus assuring a complete reproduction of the stencil image when the squeegee traverses the screen. A portion of the stencilling fluid is forced by the squeegee through the stencil screen in conventional fashion, while the excess flows directly through special openings in the squeegee into a control reservoir formed between the squeegee and the following flow coater, a portion of the fluid then flowing from the reservoir directly beneath the lower edge of the flow coater to form a layer or coating of controlled thickness on the stencil screen for the next stencilling stroke.

The bottom edge of the flow coater can be straight since the screen area being flow coated is close to the screen area between the drum and squeegee so as to be basically flat rather than sagging as occurs when the screen is flow coated on the return stroke at which time the screen is elevated off the impression surface or drum.

The invention is particularly advantageous in the printing of half tone and/or color process printing where the screen mesh orifices are very small and prove to plug from dried ink and/or capture air, either of which prevents full image reproduction.

These and other features, advantages, and objects of the invention will be apparent from a study of the detailed specification in conjunction with the drawings.

DESCRIPTION OF THE PREFERRED EMBODIMENT

Figure 7:
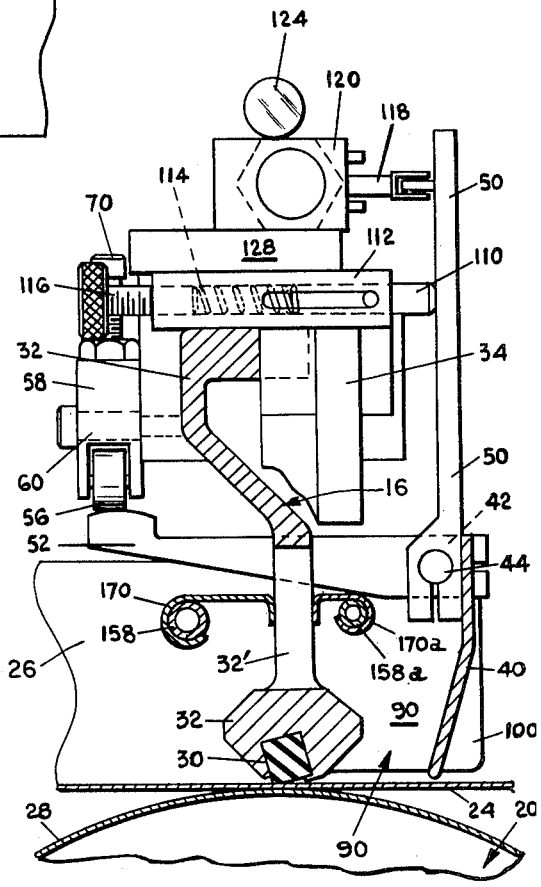
FIG. 7 is an end, partially sectional view of the apparatus in FIG. 6.

Referring now specifically to the drawings, the complete press assembly 10 there depicted includes a frame subassembly 12, a stencil frame subassembly 14, a squeegee subassembly 16, and a stock infeed subassembly 18. Beneath the squeegee subassembly 16 is a stock supporting subassembly 20 (FIG. 7), most frequently a rotational cylinder or drum. The framework subassembly 12 and stock supporting subassembly 20 may be of conventional construction as in U.S. Pat. No. 2,606,492 or U.S. Pat. No. 3,120,180, for example. Alternatively, the stock support can be flat as in U.S. Pat. No. 2,917,997, for example. The stock infeed subassembly 18 and outfeed subassembly can also be conventional.

The particular stock involved may be either sheet stock or web stock. If web stock, web handling equipment of the type set forth in U.S. Pat. Nos. 3,779,160 or 3,650,207 can be employed. The stencil frame subassembly 14 can also be of conventional type as, for example, in U.S. Pat. Nos. 3,359,663 or 3,273,497.

The squeegee subassembly 16 is located above the stock support or impression cylinder subassembly 20, while the stencil frame 26 is therebetween in usual fashion. Relative motion between the squeegee 32 and stencil 24 is preferably achieved by not moving the squeegee 32 horizontally, while horizontally reciprocating the stencil 24 with its frame and advancing the stock support.

Figure 6:
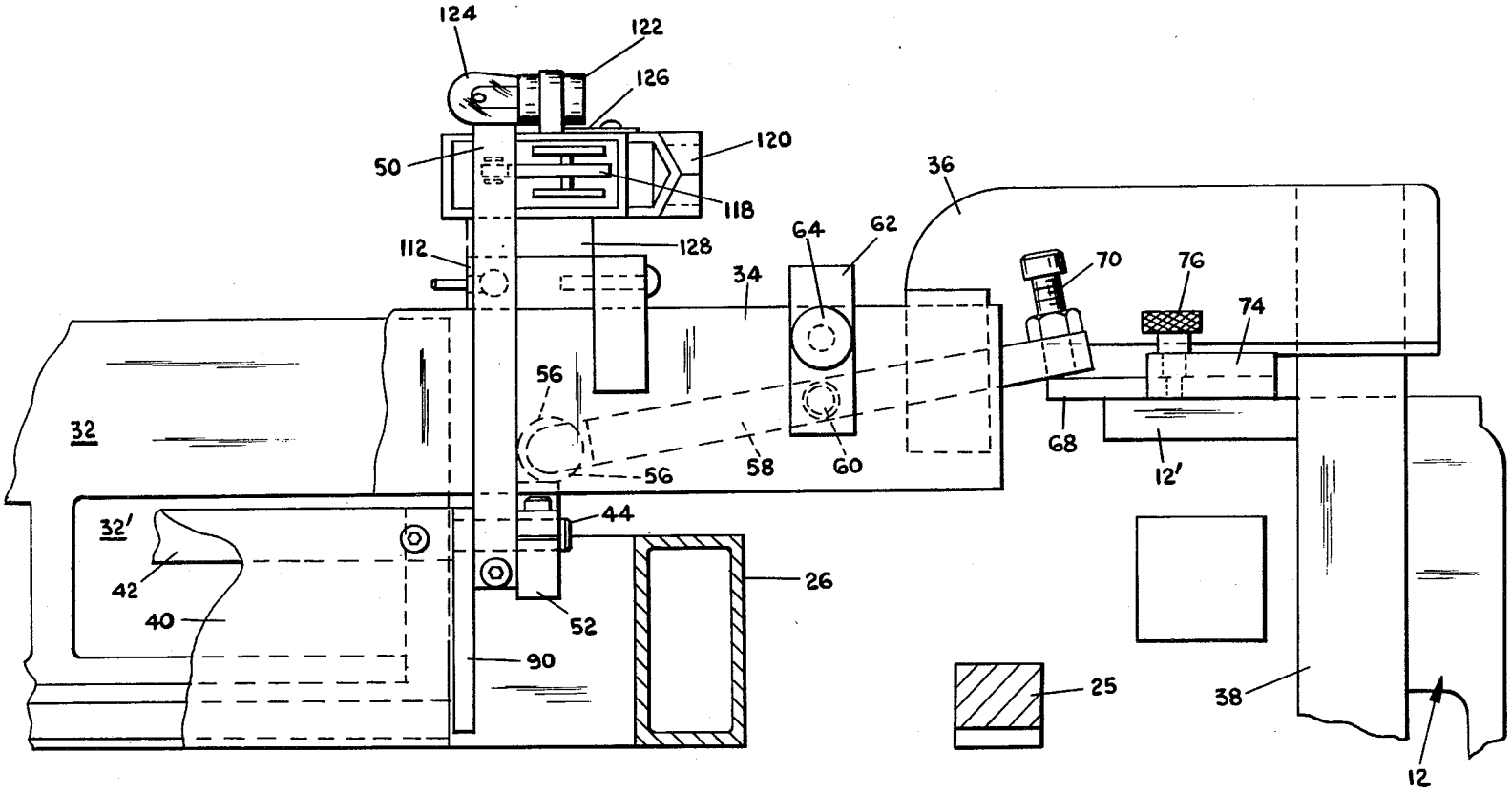
FIG. 6 is an elevational view of the apparatus in FIG. 5.

The stencil screen 24 extends across the bottom place of stencil frame 26 immediately above the surface of support 20 upon which stock 28 is maintained, so that resilient blade element 30 of squeegee 32 can force a portion of the stencilling fluid through the open pattern areas of the stencil screen onto the stock 28 as the relative motion between the squeegee and stencil screen occurs. Relative movement is made to occur between the stencil frame and the squeegee and flow coater assembly during stencilling, usually by moving the stencil frame. In this disclosure, for convenience such relative movement will sometimes be referred to in terms of advancement of the squeegee and flow coater. The stencil frame can be reciprocated by suitable gears engaging racks 25 (FIG. 6), or the like. Stock 28 advances with the screen, at the same rate and in the same direction in conventional fashion.

The transversely extending squeegee 32 is supported along the crown of the drum 20 on a suitable mounting plate 34, the opposite ends of which are secured to a pair of brackets 36. These brackets in turn are mounted upon vertically reciprocable columns 38 slidably supported in framework 12 of the press. Suitable shifting mechanism such as cams, solenoids, air cylinders, or the like (not shown) are connected in conventional fashion to reciprocate columns 38 and thus raise and lower the squeegee subassembly 16 relative to the stencil frame 26. Normally, the stencil frame is also caused to move vertically relative to support cylinder 20 by shifting the stencil frame vertically up away from the support cylinder during the nonprint return stroke of the stencil frame, so as not to smear the freshly coated liquid on the stock. Alternatively, the cylinder or drum 20 can be lowered away from the stencil screen 24 for this purpose. Since this forms no part of the present invention and is very conventional, further description is not necessary.

Spaced behind upstanding squeegee 32, relative to the squeegee direction of advance in the print stroke, is an upright, generally vertical flow coater panel 40 which serves as a flow coater blade, the lower edge of which is vertically spaced slightly above the horizontal plane of the lower edge of blade element 30 of squeegee 32. This spacing thus spaces it slightly above the stencil screen also, and is preset to a controlled fraction of an inch for obtaining a predetermined coating thickness of the spreading fluid flowing from the reservior 90 beneath the flow coater blade onto the screen during the printing stroke. This flow coater 40 also extends transversely of the stencil screen frame, being parallel to the squeegee.

It has its upper edge mounted to a support member 42 having pivot pins 44 on its opposite ends. These pivot pins 44 rotate with pivoting of the flow coater, and are pivotally mounted in a pair of end plates 100 to support the flow coater.

If the viscosity control aspect of the parent application hereof is employed, there is also secured on one of these pivot pins 44, i.e., on one end of the squeegee subassembly, a first upright lever 50 and a second longitudinally extending lever 52. Lever 50 is pivotally responsive to pivotal movement of flow coater 40 to actuate switching mechanism 120 in a manner to be described. Lever 52 is operated by a cam roller 56 to forcefully pivot flow coater 40 toward and away from the squeegee 32 in a manner to be described, for closing and opening the bottom of reservoir 90. Roller 56 engages the free end of cantilevered lever 52. This roller is on the end of a fulcrumed lever 58. Lever 58 is pivotally secured intermediate its ends on a pin 60. Pin 60 is attached to bracket 62 which in turn is secured to mount 34 by a threaded fastener 64. The opposite end of lever 58 from wheel 56 is adapted to abut a stop plate 68. An abutment stud 70 on lever 58 is vertically adjustable to control the engagement with stop plate 68 in a fashion and for a reason to be understood from the description to follow. Stop plate 68 is laterally slidable on a fixed plate portion 12' of frame subassembly 12 within guide 74, to be shiftable to an inactive position out of engagement with lever 58. The position of stop plate 68 relative to guide 74 can be varied by loosening set screw 76 to allow its shank to shift in slot 74'. Raising and lowering of mount 34 by columns 38 causes lever 58 to pivot with engagement and disengagement of stop plate 68 to shift wheel 56 vertically, thereby shifting lever 52 vertically which moves flow coater 40 toward and away from squeegee 32. The space between squeegee 32 and flow coater 40 defines a fluid reservoir 90 (FIG. 7) generally closed on the ends by end plates 100. When flow coater 40 is shifted into engagement with the back surface of squeegee 32, this reservoir is closed at the bottom, while shifting of flow coater 40 away from the squeegee opens the bottom of this reservoir to allow liquid to be in contact with stencil screen 24 and to also flow under the lower edge of the flow coater when the stencil is advanced. End plates 100 have their forward edges secured to squeegee 32, and extend back astraddle the ends of flow coater 40.

The shifting of flow coater 40 by lever 52 is for the purpose of opening and closing this reservoir during the print and return strokes, respectively, as will be understood more fully from the description to follow. Thus, printing ink or other functional stencilling fluid is dispensed from this reservoir 90 and uniformly coated on the stencil by flow coater 40, as the squeegee prints ahead of this flow coater and reservoir.

Any excess ink ahead of the squeegee can flow up and back through passages 32', i.e., directly through the body of the squeegee, into reservoir 90 behind the squeegee and in front of flow coater panel 40. If the excess ink does not flow over the squeegee, i.e. through the squeegee body, as sometimes occurs, but rather flows out ahead thereof, the arrival of the squeegee at the end of the stencil screen frame will cause the ink to dam up and at that time flow through the squeegee body. During the printing stroke, a controlled portion of the stencilling fluid in the reservoir also flows out beneath the lower edge of the flow coater panel onto the screen to recoat it. Hence there can be a constant flow through operation during printing, and the stencil screen ahead of the squeegee, within the squeegee assembly, and behind the flow coater is constantly kept covered with fluid in a print and flow function. Thus, the screen is not exposed to air to either dry the ink on the strands and thereby cause partial or total plugging of the mesh orifices, or to form an air pocket preventing total image reproduction with the subsequent printing strokes. Hence faster drying inks can be effectively used to thereby lessen subsequent drying time and energy.

Figure 4:
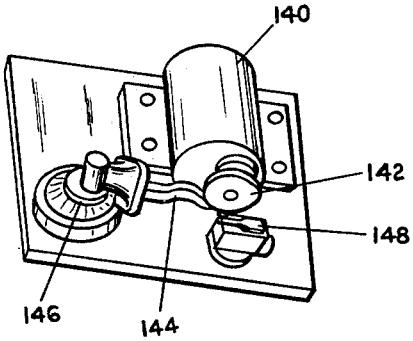
FIG. 4 is a perspective view of the fluid pumping portion of the apparatus.
Figure 2:
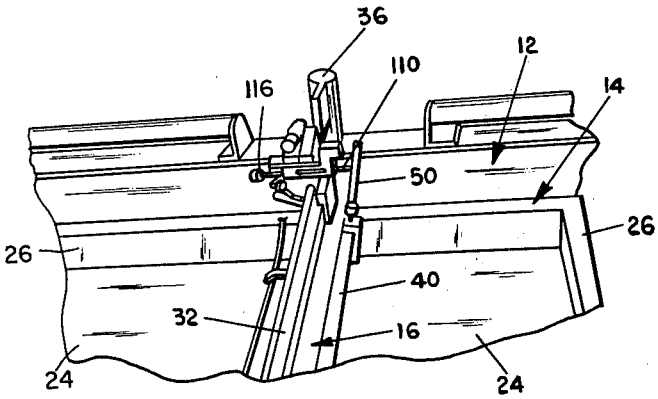
FIG. 2 is a fragmentary, somewhat enlarged perspective view of a portion of the press in FIG. 1.
Figure 5:
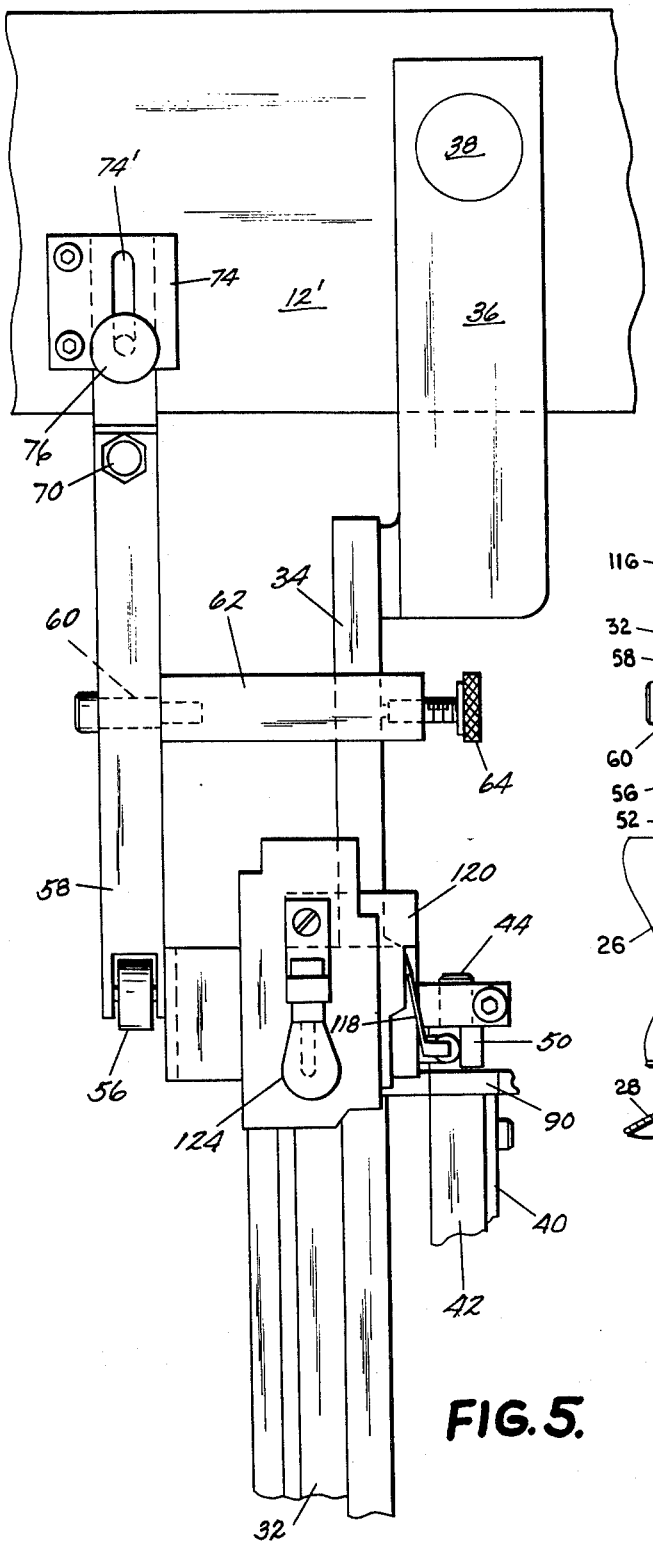
FIG. 5 is a substantially enlarged plan view of a portion of the apparatus in FIG. 2.

If it is desired to employ the solvent additive feature of this assembly, as the viscosity increases slightly, the flowing force of the ink or other fluid through the restricted area of the slot beneath the lower edge of flow coater 40 and above the upper surface of the screen increases, causing the flow coater to proportionately pivot counterclockwise (as viewed in FIG. 7) about pivot pins 44. This then applies a rotational shifting force to lever 50, overcoming the controlled bias on slide plunger 110 (FIG. 7) which engages lever 50 intermediate its ends and is slidably mounted in a housing 112. The bias is supplied by a compression coil spring 114 trapped in this housing between the inner end of pin 110 and an adjustable stud 116. Also engaging the upper end of lever 50 is the spring-mounted actuator 118 of a conventional limit switch 120. Mounted atop this limit switch by a bracket 126 is a bulb socket 122 retaining a lightbulb 124 therein. Switch 120 is mounted on support 128 above housing 112 which in turn is secured to member 34. A predetermined arcuate movement, therefore, of lever 50 in a counterclockwise direction will ultimately cause the limit switch to be activated when the viscosity increases to a certain predetermined value. This electrically actuates the bulb 124 but more importantly, simultaneously activates electrical motor 140 (FIG. 4) which operates a pump 46.

Figure 3:
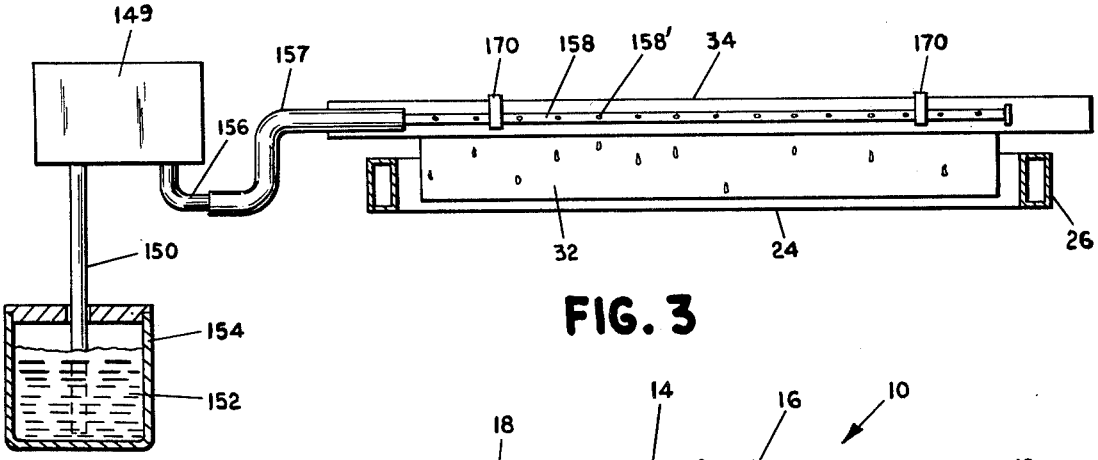
FIG. 3 is an elevational, partially schematic view of the squeegee assembly of this invention.
Figure 1:
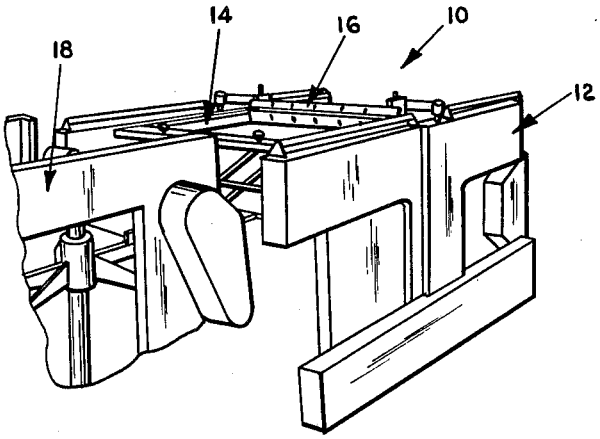
FIG. 1 is a perspective view of a stencil screen printing press employing this invention.

This motor has a cam 142 mounted on its drive shaft, which cam engages with a cam follower 144 forming part of a liquid pump 146. This can be a simple diaphragm pump such as a fuel pump from an internal combustion engine or the like. Rotation of the cam 142 reciprocates cam follower 144 to cause a pumping action, which preferably is limited to one rotation of cam 142 by another limit switch 148 activated by the cam as it completes one revolution. Pump 146 has a supply conduit 150 (FIG. 3) communicating with a supply 152 of liquid in a suitable container 154 forming a reservoir. An output 156 from the pump includes a perforated dispensing tube 158 extending over the stencil frame adjacent squeegee 32. The motor 140, pump 146, and control switch 148 are preferably enclosed in a housing 149 (FIG. 3).

Liquid dispensing tube 158 can be mounted immediately ahead of squeegee 32, relative to the direction of printing motion of the squeegee. This is shown in FIG. 3 and in phantom lines in FIG. 7. This tube can be held in position by any suitable brackets 170 attached to squeegee 32. An alternative positioning of tube 158 is shown at 158a in FIG. 7, i.e., behind squeegee 32, between squeegee 32 and flow coater 40, above the fluid level in reservoir 90. Again, suitable brackets **170*a* may be attached to squeegee 32 to support the tube in this position. Each of these two positions is advantageous for certain types of arrangements as explained more fully hereinafter. Outlet 156 from the pump is connected to this conduit dispensing tube 158 as by a flexible conduit 157** or the like to allow the squeegee subassembly to be freely vertically reciprocated.

Extensive experimentation with the apparatus disclosed has shown that the solvent additive feature is not always necessary. The unique structure and arrangement of the components themselves in this novel print and flow system serve to stabilize the condition and operation of the stencilling fluid.

OPERATION

The operation of the press basically includes a print stroke and a return stroke. During the print stroke, the stencil screen frame 26 with screen 24 moves in one direction between the lowered squeegee subassembly 16 and the underlying stock on the stock support 28 subassembly 20. During the return stroke, the stencil screen 24 is returned while the squeegee subassembly 16 is elevated and the stencil screen is out of engagement with the departing stock just printed. During this return stroke, the new stock is introduced to be subsequently printed.

The operation is started by inserting a stencil screen 24 with the desired stencil thereon between the squeegee subassembly 16 and support cylinder 20 and preparing the web or sheet stock 28 to be fed into registry on the support surface or cylinder 20. Ink or other functional stencilling fluid is placed in reservoir 90 between squeegee 32 and flow coater 40 while the squeegee subassembly is elevated by columns 38. In this condition, the flow coater is preferably in engagement with the back edge of the squeegee to close off the bottom of reservoir 90.

Excess solvent or carrier liquid for the ink or other functional liquid may be contained in reservoir 154 and motor 140 is inactive at this time.

During the print stroke, columns 38 are lowered, thereby lowering the entire squeegee subassembly into printing relationship relative to the stencil screen. On the first stroke, the unit will not print unless ink has been previously applied to the stencil screen, because the ink is flow coated on the screen immediately behind the squeegee during the print stroke. Assuming, therefore, that the second print stroke is about to begin, and the squeegee subassembly is lowered, this causes the outer end of lever 58 to engage stop plate 68, causing it to pivot about its central pin 60 to lower wheel 56 and thereby depress lever 52. This depression rotation of lever 52 about its pivot 44 causes flow coater 40 to tilt away from the squeegee and open the bottom of reservoir 90.

The shifting of flow coater 40 away from squeegee 32 is against the bias of coil spring 114 compressed by pin 110 as lever 50 pivots with the flow coater. This initial pivoting of lever 50 also depresses part way the limit switch 118 but insufficient to throw the switch. Instead of this mechanical lever system of opening and closing the reservoir by shifting the flow coater out of and into engagement with the squeegee, alternative operating means could be employed such as an electrical solenoid, a fluid cylinder, and the like.

As the stencil screen moves beneath the squeegee and flow coater, squeegee blade 30 in engagement with the screen forces a portion of the ink ahead of it through stencil 24 onto stock 28 on support surface 20. Excess ink ahead of the squeegee blade can flow up and back through openings 32' in the body of squeegee 32 above blade 32, into reservoir 90 behind the squeegee, i.e. between the upright squeegee and the flow coater panel. As the squeegee prints, the trailing flow coater, by its slight spacing above stencil 24, allows a controlled thickness of liquid to flow from reservoir 90, beneath the lower edge of flow coater 40, and onto stencil 24 for the next print stroke. Thus, during the print stroke, there is a steady flow of stencilling fluid through the stencil subassembly, keeping the stencil covered with fluid, keeping a minimum of excess fluid in front of the squeegee and a controlled thickness behind the flow coater, using the reservoir as a variable quantity control. At the end of the stroke, as the squeegee and the end panel of the stencil frame are brought into close proximity, more excess ink tends to be forced back through the squeegee body into the reservoir.

During the return stroke, after the print stroke has been completed, the squeegee subassembly is elevated by columns 38, enabling the stencil screen to be returned to its initial position without the squeegee forcing ink through it on the return stroke.

Lifting of the squeegee subassembly enables lever 58 to shift away from stop plate 68, allowing wheel 56 to rise, allowing lever 52 to rise, and enabling compression spring 114 to shift lever 50, which thereby rotates the flow coater 40 into engagement with squeegee 32 to close the bottom of the liquid reservoir 90. The stencil frame is also shifted vertically above the print cylinder and stock during this return stroke.

In some operations, after repeated print strokes and return strokes, with the ink being repeatedly flow coated onto the stencil and excess ink being recycled back into reservoir 90 through openings 32' in squeegee 32, sufficient evaporation of the solvent or carrier liquid occurs to increase the viscosity of the ink or other functional liquid being coated. If the viscosity sensing and solvent supply system is employed, the flow coater 40 senses the increased viscosity of the liquid flowing through the restricted slot defined by its lower edge and the stencil. The increased drag on the flow coater with increased viscosity of the fluid causes the lower edge of the flow coater to pivotally shift to the rear, shifting lever 50 further against the bias of compression coil 114 until finally, at a predetermined viscosity, actuator 118 of limit switch 120 is shifted a sufficient amount to throw the limit switch. The amount of viscosity required to do this can be preset by adjusting the knob 116 to vary the initial preset compression on spring 114, and thus, the bias supplied thereto in opposition to the lever 150 actuating limit switch 120. When limit switch 120 is activated, it allows electrical power to flow to electric motor 140 that operates pump 146 through cam 42. This motor cycles through one revolution (or otherwise as desired) until limit switch 148 is thrown to deactivate the system, and during which time pump 146 sends a predetermined supply of solvent or carrier liquid from reservoir 154 through line 150, through the pump, through line 156–157 and into conduit 158 where the liquid is dispensed through its series of spaced orifices 158'. This drops down into the ink or other functional liquid to lower the viscosity thereof. Lowering this viscosity will, in succeeding printing strokes, cause the flow coater to shift a less amount and thereby prevent actuation of the pump again until the critical viscosity is again reached. Indicator bulb 124 shows when the pump is in operation.

Various additional features, advantages, and objects of this invention will occur to those in the art upon reviewing this disclosure. The particular constructional details set forth are intended to be illustrative of the inventive concept, which is to be limited only by the scope of the appended claims and the reasonably equivalent structures to those defined therein.

The embodiments of the invention in which an exclusive property or privilege is claimed are defined as follows.

1. Stencilling apparatus comprising:

means for supporting stock to be stencilled;

means for supporting a stencil screen above said stock supporting means;

an upstanding squeegee having a forward face portion, a rearward face portion, and a lower edge portion including a resilient squeegee element for forcing fluid down through the stencil screen onto stock on said stock supporting means;

an upright flow coater panel having a lower edge;

means for supporting said flow coater panel in spaced relationship behind said upstanding squeegee relative to the direction of stencilling, forming a fluid reservoir therebetween and for causing said squeegee and said flow coater panel to be advanced simultaneously relative to the stencil screen during a stencilling stroke;

said flow coater panel lower edge being mounted slightly elevated relative to said resilient squeegee element lower edge portion and to the stencil screen, for fluid flow from said fluid reservoir beneath said lower edge of said flow coater panel when said flow coater panel is advanced, to flow coat said screen for the next stencilling stroke;

recycle passage means through said squeegee, above said squeegee element, from said squeegee forward face portion to said squeegee rearward face portion, for direct flow through said squeegee and into said reservoir, of excess fluid on the screen forwardly of said squeegee when said squeegee is advanced, whereby simultaneous advancement of said squeegee and flow coater panel in a stencilling and flow coating stroke results in a stencil-and-flow function keeping the screen covered with fluid by a portion of the fluid ahead of said squeegee being forced down through said screen, and excess fluid that is not forced through said screen being able to flow from ahead of said squeegee through said squeegee into said reservoir, and a portion of the fluid in said reservoir being caused to flow from said reservoir beneath said flow coater lower edge onto the screen to flow coat the screen for the next stencilling stroke.

2. Stencilling apparatus comprising:

means for supporting stock to be stencilled;

means for supporting a stencil screen above said stock supporting means;

an upstanding squeegee having a body with forward face portion, a rearward face portion, and a lower resilient squeegee element for forcing fluid down through the stencil screen onto stock on said stock supporting means;

an upright flow coater panel having a lower edge;

means for supporting said flow coater panel in spaced relationship behind said upstanding squeegee relative to the direction of advancement, forming a fluid reservoir therebetween and for causing said squeegee and said flow coater panel to be advanced simultaneously during a stencilling stroke;

said flow coater panel lower edge being mounted relative to the stencil screen for fluid flow from said fluid reservoir beneath said lower edge of said flow coater panel when said flow coater panel is advanced, to flow coat said screen for the next stencilling stroke;

passage means through said squeegee body, above said squeegee element, from said squeegee forward face portion to said squeegee rearward face portion, for direct flow through said squeegee body and into said reservoir, of excess fluid on the screen forwardly of said squeegee when said squeegee is advanced, whereby simultaneous advancement of said squeegee and flow coater panel in a stencilling and flow coating stroke results in a stencil-and-flow function keeping the screen covered with fluid, a portion of the fluid ahead of said squeegee being forced down through said screen, and excess fluid is not forced through said screen being able to flow from ahead of said squeegee through said squeegee body into said reservoir, and a portion of the fluid in said reservoir being caused to flow from said reservoir beneath said flow coater lower edge onto the screen to flow coat the screen for the next stencilling stroke.

* * * * *